US009257741B2

(12) United States Patent
Cheng

(10) Patent No.: US 9,257,741 B2
(45) Date of Patent: Feb. 9, 2016

(54) DIRECTIONAL ANTENNA STRUCTURE WITH DIPOLE ANTENNA ELEMENT

(71) Applicant: Wistron NeWeb Corp., Hsinchu (TW)

(72) Inventor: Chia-Shang Cheng, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 63 days.

(21) Appl. No.: 14/196,719

(22) Filed: Mar. 4, 2014

(65) Prior Publication Data

US 2015/0042533 A1 Feb. 12, 2015

(30) Foreign Application Priority Data

Aug. 9, 2013 (TW) ..... 102128593 A

(51) Int. Cl.
*H01Q 1/36* (2006.01)
*H01Q 9/28* (2006.01)
*H01Q 19/10* (2006.01)

(52) U.S. Cl.
CPC . *H01Q 1/36* (2013.01); *H01Q 9/28* (2013.01); *H01Q 19/108* (2013.01)

(58) Field of Classification Search
USPC ..... 343/726, 797, 815, 817, 818, 819, 833, 343/834
See application file for complete search history.

(56) References Cited

U.S. PATENT DOCUMENTS

| | | | | |
|---|---|---|---|---|
| 3,546,705 | A * | 12/1970 | Lemson | 343/797 |
| 5,559,523 | A * | 9/1996 | Smith et al. | 343/795 |
| 6,975,278 | B2 * | 12/2005 | Song et al. | 343/795 |
| 2010/0207831 | A1 | 8/2010 | Wu | |
| 2011/0018776 | A1 | 1/2011 | Brown | |
| 2013/0082893 | A1 * | 4/2013 | Wang et al. | 343/810 |
| 2013/0178169 | A1 * | 7/2013 | Kuo et al. | 455/73 |

FOREIGN PATENT DOCUMENTS

CN 102377016 A 3/2012

* cited by examiner

*Primary Examiner* — Howard Williams
(74) *Attorney, Agent, or Firm* — Muncy, Geissler, Olds & Lowe, P.C.

(57) ABSTRACT

An antenna structure includes a dipole antenna element, a closed-loop conductor, and a reflection plane. The dipole antenna element is configured to transmit an electromagnetic signal. The closed-loop conductor is disposed adjacent to the dipole antenna element. The dipole antenna element is substantially between the closed-loop conductor and the reflection plane, or the closed-loop conductor is substantially between the dipole antenna element and the reflection plane. The reflection plane is configured to reflect the electromagnetic signal from the dipole antenna element so as to enhance the total gain of the antenna structure. The mutual coupling effect between the closed-loop conductor and the dipole antenna element effectively causes the distance between the dipole antenna element and the reflection plane to be shorter.

18 Claims, 11 Drawing Sheets

DIRECTIONAL ANTENNA STRUCTURE WITH DIPOLE ANTENNA ELEMENT

CROSS REFERENCE TO RELATED APPLICATIONS

This application claims priority of Taiwan Patent Application No. 102128593 filed on Aug. 9, 2013, the entirety of which is incorporated by reference herein.

BACKGROUND OF THE INVENTION

1. Field of the Invention

The disclosure generally relates to an antenna structure, and more particularly, to a directional antenna structure with a dipole antenna element.

2. Description of the Related Art

With the progress of mobile communication technology, portable electronic devices, such as portable computers, mobile phones, tablet computers, multimedia players, and other hybrid functional mobile devices, have become more common. To satisfy user demand, portable electronic devices can usually perform wireless communication functions. Some functions cover a large wireless communication area, for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

Since the interior space of a mobile device is limited, its antenna structure for wireless communication should have as small a size as possible. A conventional high directional antenna structure is often limited by a long distance from a radiation element to the reflection plane thereof, and cannot be applied to a variety of small mobile devices.

BRIEF SUMMARY OF THE INVENTION

In one exemplary embodiment, the disclosure is directed to an antenna structure, comprising: a first dipole antenna element, transmitting a first electromagnetic signal; a closed-loop conductor, disposed adjacent to the first dipole antenna element; and a reflection plane, reflecting the first electromagnetic signal from the first dipole antenna element to enhance the total gain of the antenna structure; wherein the first dipole antenna element is substantially between the closed-loop conductor and the reflection plane, or the closed-loop conductor is substantially between the first dipole antenna element and the reflection plane.

In another exemplary embodiment, the disclosure is directed to an antenna structure, comprising: a first dipole antenna element, transmitting a first electromagnetic signal; and a reflection plane, having a closed loop slot, wherein the reflection plane reflects the first electromagnetic signal from the first dipole antenna element to enhance the total gain of the antenna structure.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof are shown in detail as follows.

Figure 1:
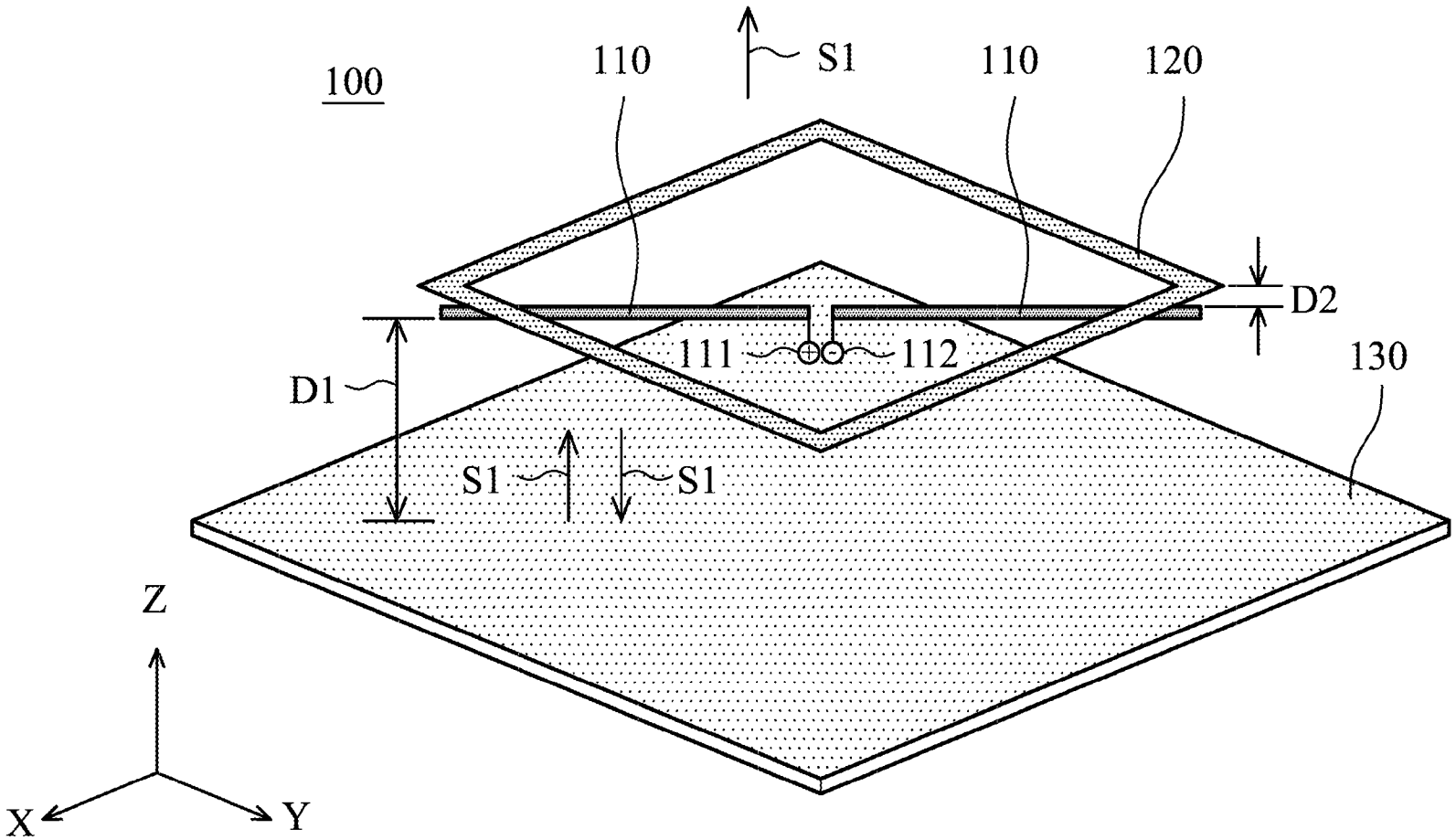
FIG. 1 is a diagram for illustrating an antenna structure according to an embodiment of the invention.

FIG. 1 is a diagram for illustrating an antenna structure 100 according to an embodiment of the invention. The antenna structure 100 may be disposed in a mobile device, such as a smartphone, a tablet computer, or a notebook computer. Furthermore, the antenna structure 100 may be independently configured as an external antenna module, and the external antenna module may be coupled to an electronic device. The antenna structure 100 may be further coupled to a communication module of the mobile device or the electronic device to provide the function of wireless communication. As shown in FIG. 1, the antenna structure 100 at least comprises a first dipole antenna element 110, a closed-loop conductor 120, and a reflection plane 130. The first dipole antenna element 110 may comprise two radiation conductors extending in opposite directions, and each radiation conductor has a length which is substantially equal to 0.25 wavelength of the central operation frequency of the first dipole antenna element 110. The first dipole antenna element 110 has a positive feeding point 111 and a negative feeding point 112, and both of them are respectively coupled to a positive electrode and a negative electrode of a signal source. The first dipole antenna element 110 is excited by the signal source, and transmits a first electromagnetic signal S1. The reflection plane 130 may be a metal ground plane. The size of the reflection plane 130 is generally much greater than the size of the first dipole antenna element 110 and the size of the closed-loop conductor 120. In some embodiments, the reflection plane 130 is disposed on a dielectric substrate, such as an FR4 (Flame Retardant 4) substrate. The reflection plane 130 is configured to reflect the first electromagnetic signal S1 from the first dipole antenna element 110 so as to enhance the total gain of the antenna structure 100.

The closed-loop conductor 120 is disposed adjacent to the first dipole antenna element 110. In the embodiment of FIG. 1, the first dipole antenna element 110 is substantially between the closed-loop conductor 120 and the reflection plane 130. In other embodiments, adjustments are made such that the closed-loop conductor 120 is substantially between the first dipole antenna element 110 and the reflection plane 130. In the embodiment of FIG. 1, the closed-loop conductor 120 substantially has a square shape. The first dipole antenna element 110 has a vertical projection (i.e., the normal vector of the projection plane is parallel to the Z-axis) on the closed-loop conductor 120, and the vertical projection is substantially aligned with a diagonal of the square shape (e.g., the length of the vertical projection is substantially equal to the length of the diagonal). When the first dipole antenna element 110 is excited, the mutual coupling effect between the closed-loop conductor 120 and the first dipole antenna element 110 effectively causes the distance D1 between the first dipole antenna element 110 and the reflection plane 130 to be shorter. For example, in the embodiments of FIG. 1, the distance D1 between the first dipole antenna element 110 and the reflection plane 130 is substantially equal to 0.125 wavelength ($\lambda/8$) of the central operation frequency of the first dipole antenna element 110, and this is much shorter than 0.25 ($\lambda/4$) wavelength of that in a conventional design.

In some embodiments, the length of the closed-loop conductor 120 is substantially from 1.1 to 1.7 wavelength of the central operation frequency of the first dipole antenna element 110. In other embodiment, the length of the closed-loop conductor 120 is substantially equal to 1.414 wavelength (e.g., 408 mm) of the central operation frequency of the first dipole antenna element 110. In some embodiments, the width of the closed-loop conductor 120 is substantially from 1 mm to 2 mm. In some embodiments, the distance D1 between the first dipole antenna element 110 and the reflection plane 130 is substantially equal to 30 mm. In some embodiments, the distance D2 between the first dipole antenna element 110 and the closed-loop conductor 120 is substantially from 1 mm to 2 mm. In some embodiments, the length and the width of the reflection plane 130 are both substantially equal to 160 mm.

Figure 2:
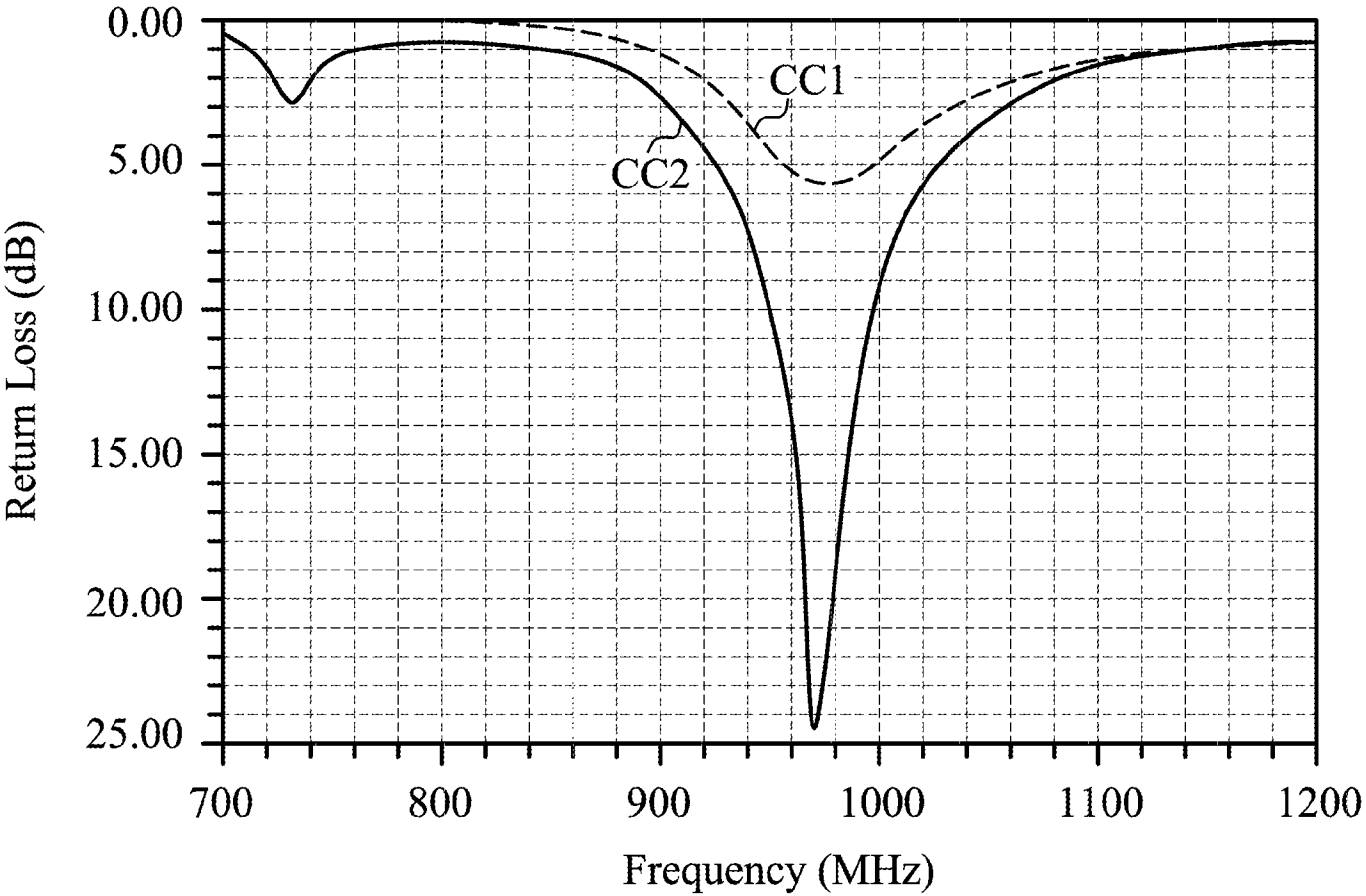
FIG. 2 is a diagram for illustrating return loss of an antenna structure according to an embodiment of the invention.

FIG. 2 is a diagram for illustrating return loss of the antenna structure 100 according to an embodiment of the invention. In the embodiment of FIG. 2, the curve CC1 represents the return loss of the antenna structure 100 without the closed-loop conductor 120, and the curve CC2 represents the return loss of the antenna structure 100 with the closed-loop conductor 120 (as shown in FIG. 1). According to the measurement of FIG. 2, the operation bandwidth of the antenna structure 100 is apparently increased after the closed-loop conductor 120 is included. Since the mutual coupling effect between the closed-loop conductor 120 and the first dipole antenna element 110 changes the input impedance of the first dipole antenna element 110, the closed-loop conductor 120 is configured to adjust the distance D1 between the first dipole antenna element 110 and the reflection plane 130 and to further reduce the total size of the antenna structure 100. Accordingly, the antenna structure of the invention has the advantages of both enhancing the antenna gain and reducing the antenna size, and it is suitably applied to a variety of small electronic devices or small mobile devices.

In addition to the above designs, the antenna structure of the invention may further comprise other dipole antenna elements and closed-loop conductors with different shapes. Please refer to the following embodiments.

Figure 3A:
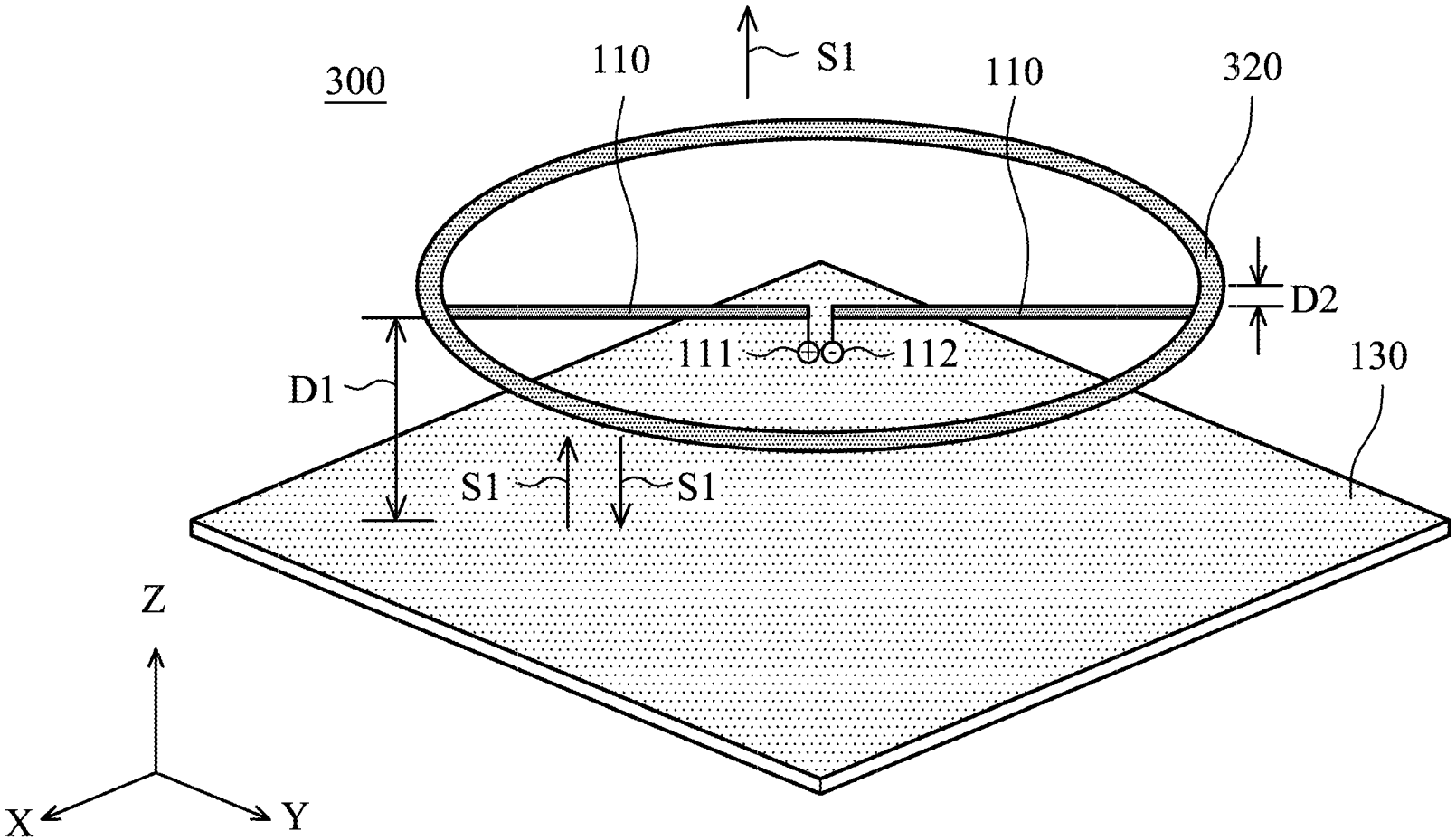
FIG. 3A is a diagram for illustrating an antenna structure according to an embodiment of the invention.

FIG. 3A is a diagram for illustrating an antenna structure 300 according to an embodiment of the invention. FIG. 3A is similar to FIG. 1. In the embodiment of FIG. 3A, a closed-loop conductor 320 of the antenna structure 300 substantially has a circular shape. The first dipole antenna element 110 has a vertical projection (i.e., the normal vector of the projection plane is parallel to the Z-axis) on the closed-loop conductor 320, and the vertical projection is substantially aligned with a diameter of the circular shape (e.g., the length of the vertical projection is substantially equal to the length of the diameter). Other features of the antenna structure 300 of FIG. 3A are similar to those of the antenna structure 100 of FIG. 1. Accordingly, the two embodiments can achieve similar levels of performance.

Figure 3B:
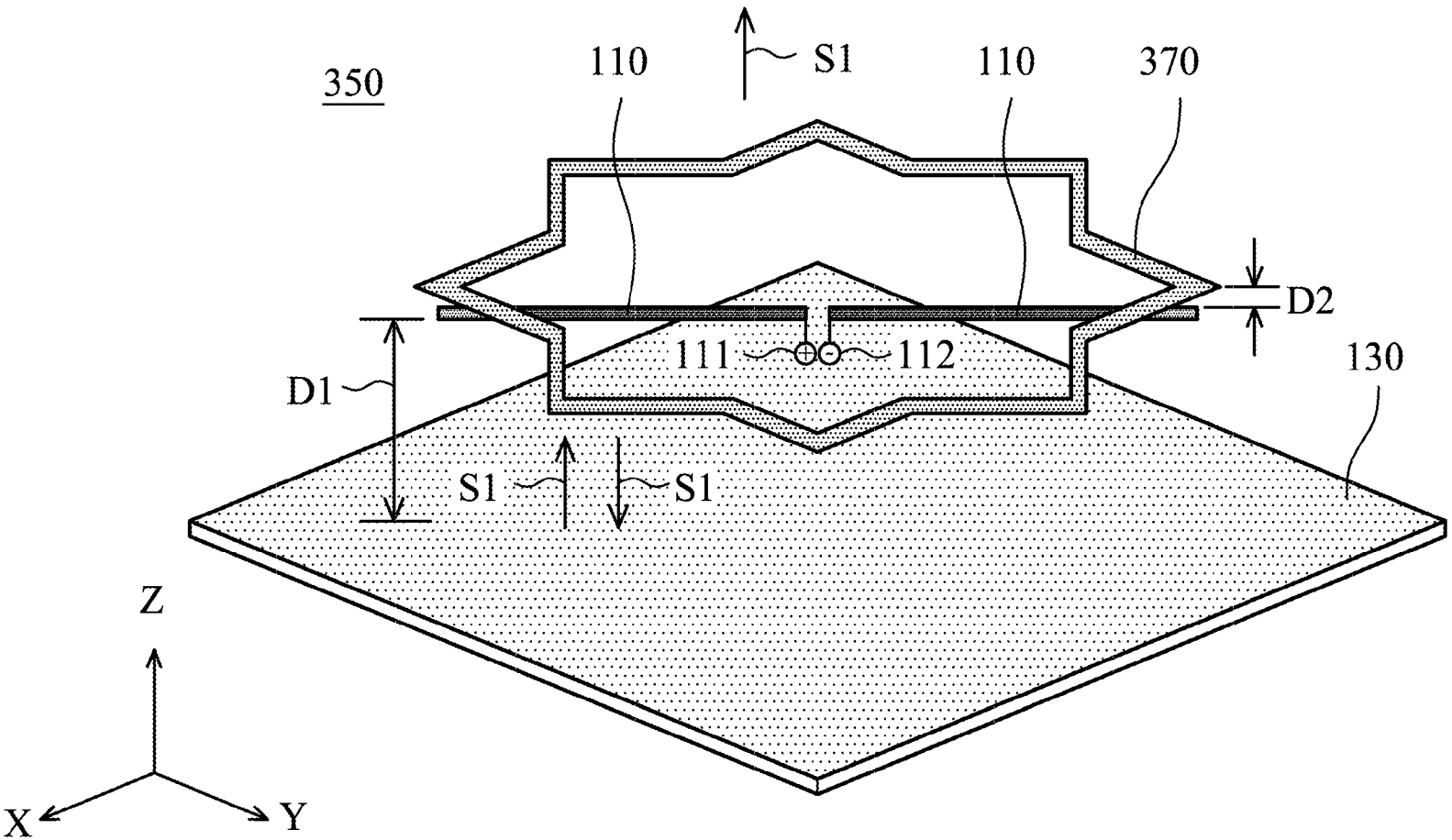
FIG. 3B is a diagram for illustrating an antenna structure according to an embodiment of the invention.

FIG. 3B is a diagram for illustrating an antenna structure 350 according to an embodiment of the invention. FIG. 3B is similar to FIG. 1. In the embodiment of FIG. 3B, a closed-loop conductor 370 of the antenna structure 350 substantially has a sixteen-side star shape. The first dipole antenna element 110 has a vertical projection (i.e., the normal vector of the projection plane is parallel to the Z-axis) on the closed-loop conductor 370, and the vertical projection is substantially aligned with a diagonal of the sixteen-side star shape (e.g., the length of the vertical projection is substantially equal to the length of the diagonal). Other features of the antenna structure 350 of FIG. 3B are similar to those of the antenna structure 100 of FIG. 1. Accordingly, the two embodiments can achieve similar levels of performance.

Figure 4:
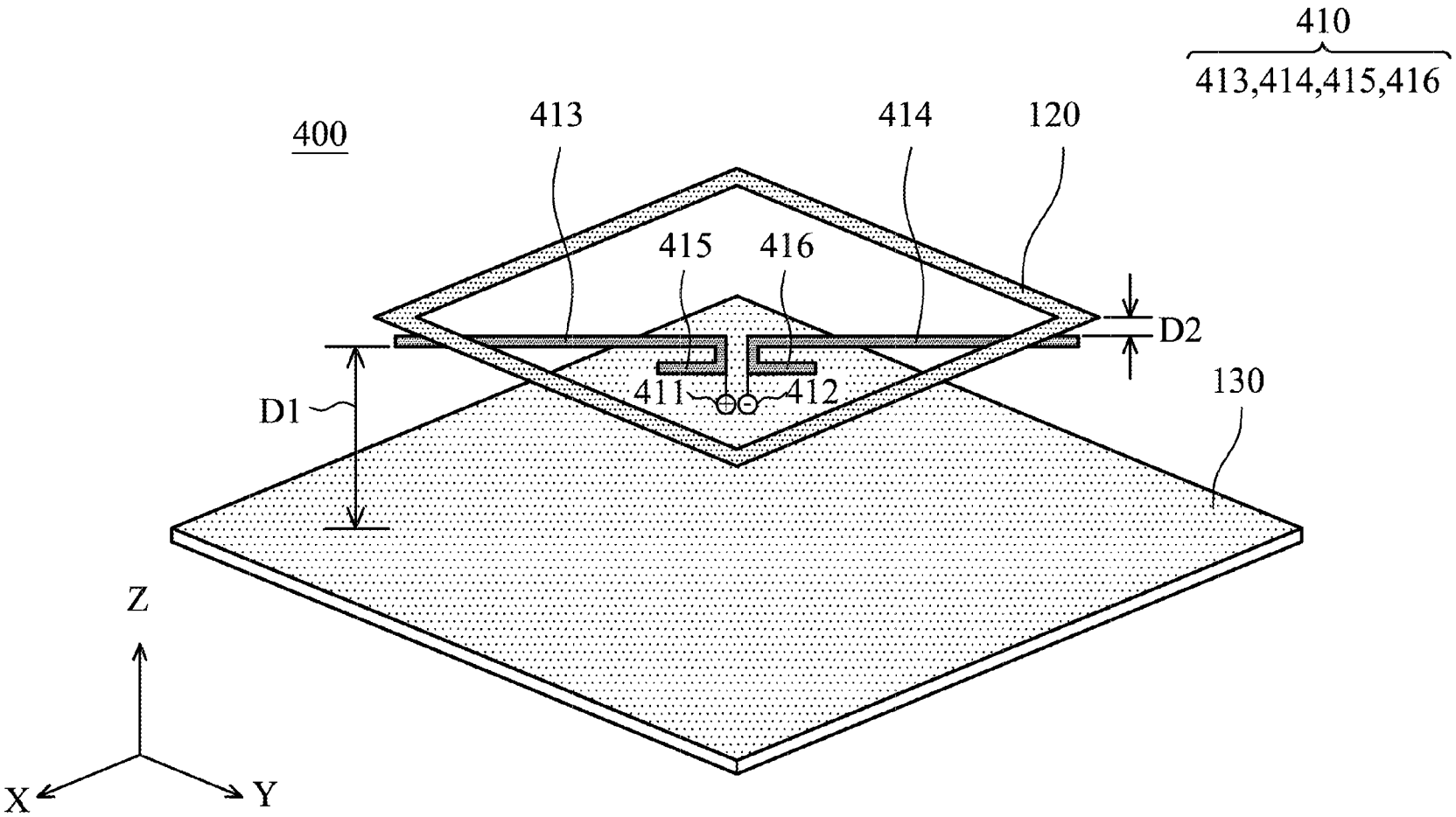
FIG. 4 is a diagram for illustrating an antenna structure according to an embodiment of the invention.

FIG. 4 is a diagram for illustrating an antenna structure 400 according to an embodiment of the invention. FIG. 4 is similar to FIG. 1. In the embodiment of FIG. 4, a first dipole antenna element 410 of the antenna structure 400 comprises at least four radiation branches 413, 414, 415, and 416 to cover dual bands. More particularly, the radiation branches 413 and 415 are both coupled to a positive feeding point 411 of the first dipole antenna element 410, and further substantially form a J-shape. In addition, the radiation branches 414 and 416 are both coupled to a negative feeding point 412 of the first dipole antenna element 410, and further substantially form another J-shape. The positive feeding point 411 and the negative feeding point 412 of the first dipole antenna element 410 are respectively coupled to a positive electrode and a negative electrode of a signal source. When the first dipole antenna element 410 is excited, the longer radiation branches 413 and 414 together generate a low band, and the shorter radiation branches 415 and 416 together generate a high band. Note that a central frequency of the low band in the embodiment of FIG. 4 is equivalent to the aforementioned central operation frequency of the first dipole antenna element 110. Other features of the antenna structure 400 of FIG. 4 are similar to those of the antenna structure 100 of FIG. 1. Accordingly, the two embodiments can achieve similar levels of performance.

Figure 5:
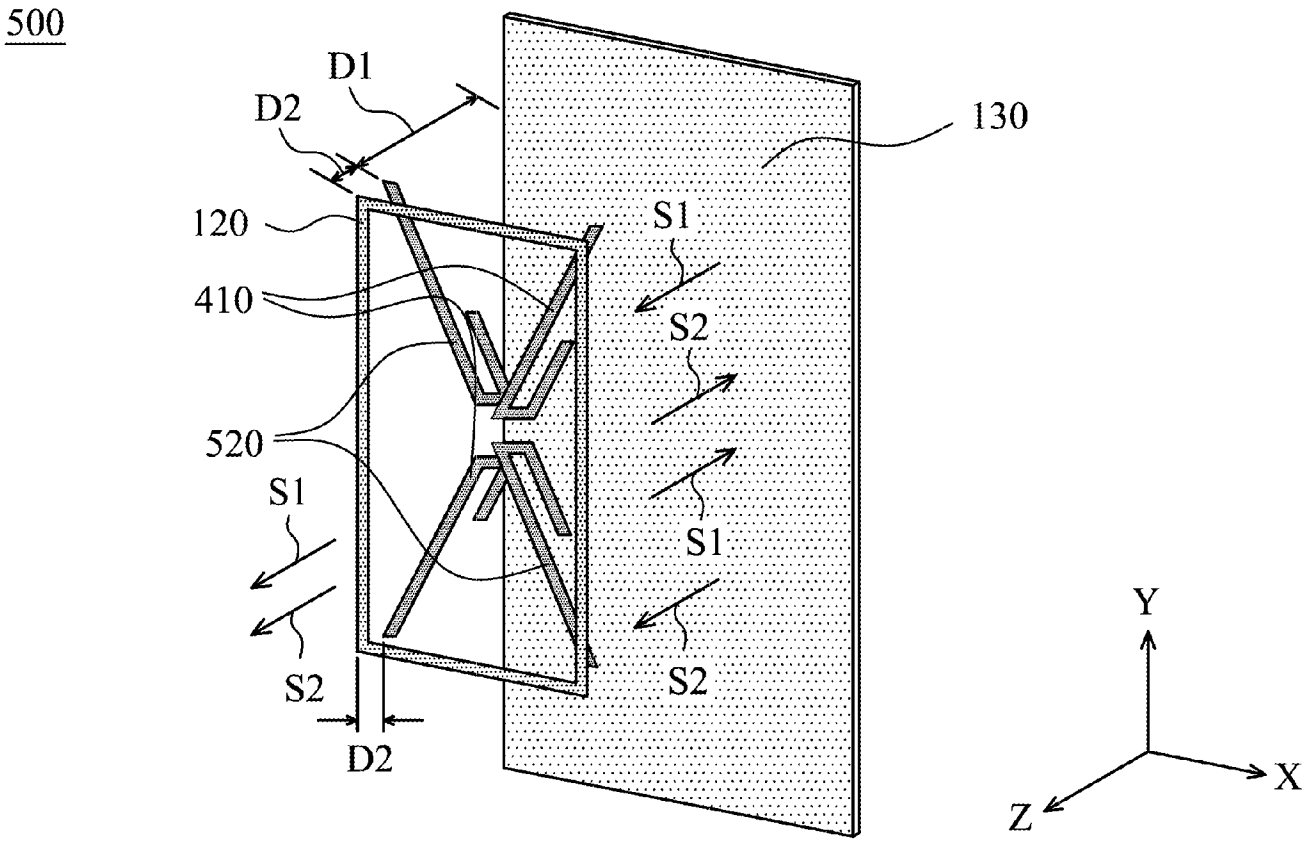
FIG. 5 is a diagram for illustrating an antenna structure according to an embodiment of the invention.

FIG. 5 is a diagram for illustrating an antenna structure 500 according to an embodiment of the invention. FIG. 5 is similar to FIG. 1. In the embodiment of FIG. 5, the antenna structure 500 further comprises a second dipole antenna element 520. The first dipole antenna element 410 and the second dipole antenna element 520 may be excited by two different signal sources. The second dipole antenna element 520 is disposed substantially perpendicular to the first dipole antenna element 410, and transmits a second electromagnetic signal S2. The closed-loop conductor 120 is further adjacent to the second dipole antenna element 520, and the reflection plane 130 is further configured to reflect the second electromagnetic signal S2 from the second dipole antenna element 520. The mutual coupling effect between the closed-loop conductor 120 and the second dipole antenna element 520 effectively causes the distance D1 between the second dipole antenna element 520 and the reflection plane 130 to be shorter. In the embodiment of FIG. 5, the second dipole antenna element 520 is identical to the first dipole antenna element 410 (e.g., the detailed structure thereof may be described in FIG. 4), and the difference between them is that the second dipole antenna element 520 is further rotated by 90 degrees. In other embodiments, each of the second dipole antenna element 520 and the first dipole antenna element 410 is identical to the first dipole antenna element 110 of FIG. 1 (i.e., each dipole antenna element includes only two radiation branches), and the angle between them is substantially equal to 90 degrees. In the embodiment of FIG. 5, the closed-loop conductor 120 substantially has a square shape. The first dipole antenna element 410 has a first vertical projection (i.e., the normal vector of the projection plane is parallel to the Z-axis) on the closed-loop conductor 120, and the second dipole antenna element 520 has a second vertical projection (i.e., the normal vector of the projection plane is parallel to the Z-axis) on the closed-loop conductor 120. The first vertical projection and the second vertical projection are substantially aligned with two perpendicular diagonals of the square shape, respectively. Since the second dipole antenna element 520 and the first dipole antenna element 410 are substantially orthogonal to each other, the antenna structure 500 can have dual linear polarizations to receive or transmit electromagnetic signals in different directions. Other features of the antenna structure 500 of FIG. 5 are similar to those of the antenna structure 100 of FIG. 1. Accordingly, the two embodiments can achieve similar levels of performance.

Figure 6:
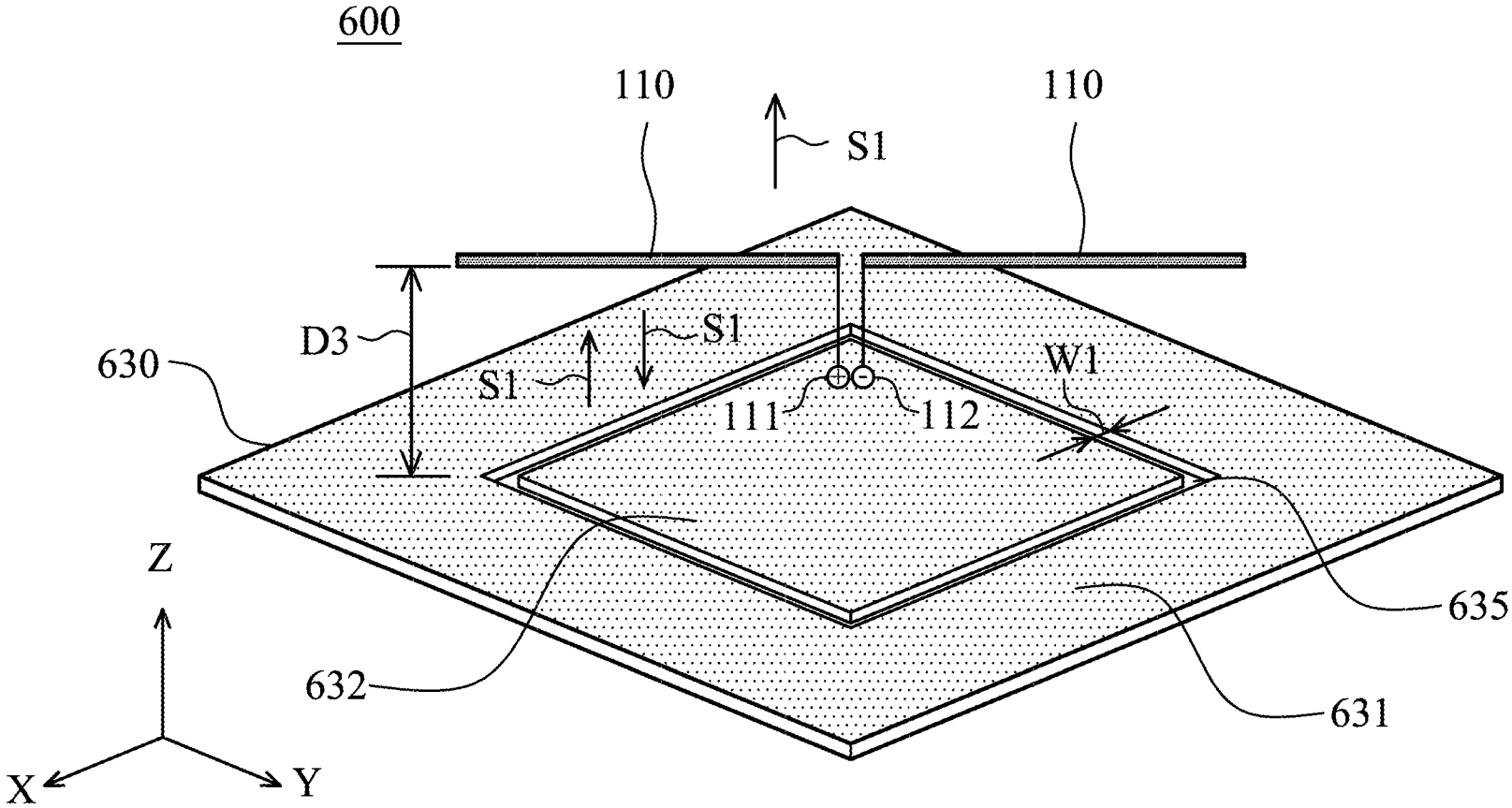
FIG. 6 is a diagram for illustrating an antenna structure according to an embodiment of the invention.

FIG. 6 is a diagram for illustrating an antenna structure 600 according to an embodiment of the invention. As shown in FIG. 6, the antenna structure 600 at least comprises a first dipole antenna element 110 and a reflection plane 630. The first dipole antenna element 110 may be excited by a signal source and transmit a first electromagnetic signal S1. The detailed structure of the first dipole antenna element 110 may be described in the embodiment of FIG. 1. The reflection plane 630 may be a metal ground plane, and its size is generally much greater than the size of the first dipole antenna element 110. In some embodiments, the reflection plane 630 is disposed on a dielectric substrate, such as an FR4 substrate. The reflection plane 630 is configured to reflect the first electromagnetic signal S1 from the first dipole antenna element 110 so as to enhance the total gain of the antenna structure 600. The reflection plane 630 has a closed loop slot 635. More particularly, the reflection plane 630 comprises an outer ring portion 631 disposed outside the closed loop slot 635 and an inner ring portion 632 disposed inside the closed loop slot 635. The whole outer ring portion 631 is separated from the inner ring portion 632 by the closed loop slot 635. In the embodiment of FIG. 6, the closed loop slot 635 substantially has a square shape. The first dipole antenna element 110 has a vertical projection (i.e., the normal vector of the projection plane is parallel to the Z-axis) on the reflection plane 630, and the vertical projection is substantially aligned with a diagonal of the square shape (e.g., the length of the vertical projection is greater than the length of the diagonal). When the first dipole antenna element 110 is excited, the mutual coupling effect between the outer ring portion 631 of the reflection plane 630 and the first dipole antenna element 110 effectively causes the distance D3 between the first dipole antenna element 110 and the reflection plane 630 to be shorter. For example, in the embodiments of FIG. 6, the distance D3 between the first dipole antenna element 110 and the reflection plane 630 is substantially equal to 0.125 wavelength ($\lambda/8$) of the central operation frequency of the first dipole antenna element 110, and this is much shorter than 0.25 ($\lambda/4$) wavelength of that in a conventional design. In some embodiments, the inner ring portion 632 of the reflection plane 630 may be removed, such that the reflection plane 630 substantially has a central hollow structure.

In some embodiments, the length of the closed loop slot 635 is substantially from 0.8 to 1.2 wavelength of the central operation frequency of the first dipole antenna element 110. In other embodiment, the length of the closed loop slot 635 is substantially equal to 1 wavelength (e.g., 288 mm) of the central operation frequency of the first dipole antenna element 110. In some embodiments, the width W1 of the closed loop slot 635 is substantially from 1 mm to 2 mm. In some embodiments, the distance D3 between the first dipole antenna element 110 and the reflection plane 630 is substantially equal to 30 mm. In some embodiments, the length and the width of the reflection plane 630 are both substantially equal to 160 mm.

Figure 7:
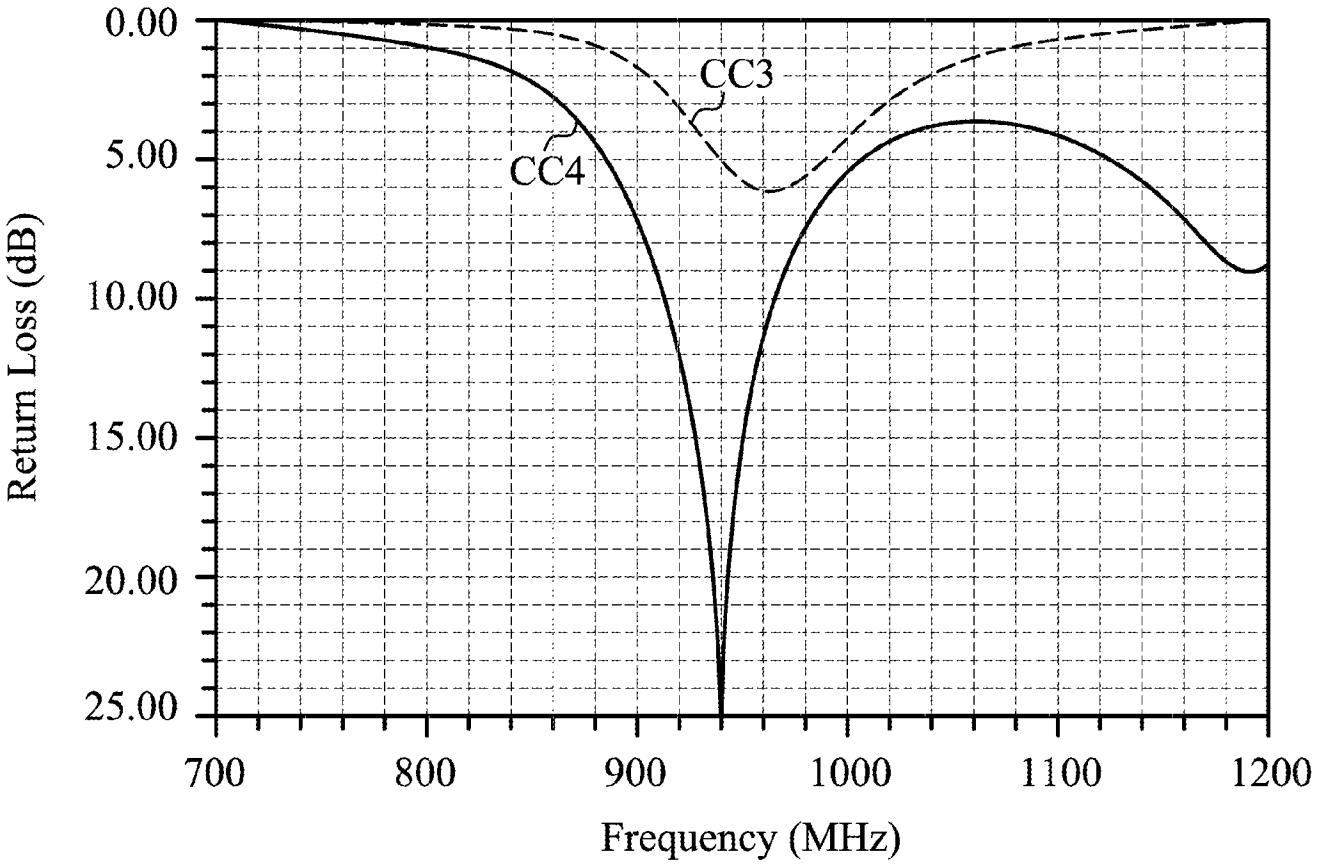
FIG. 7 is a diagram for illustrating return loss of an antenna structure according to an embodiment of the invention.

FIG. 7 is a diagram for illustrating return loss of the antenna structure 600 according to an embodiment of the invention. In the embodiment of FIG. 7, the curve CC3 represents the return loss of the antenna structure 600 comprising the reflection plane 630 without the closed loop slot 635, and the curve CC4 represents the return loss of the antenna structure 600 comprising the reflection plane 630 with the closed loop slot 635 (as shown in FIG. 6). According to the measurement of FIG. 7, the operation bandwidth of the antenna structure 600 is apparently increased after the closed loop slot 635 is formed in the reflection plane 630. Since the mutual coupling effect between the outer ring portion 631 of the reflection plane 630 and the first dipole antenna element 110 changes the input impedance of the first dipole antenna element 110, the outer ring portion 631 of the reflection plane 630 is configured to adjust the distance D3 between the first dipole antenna element 110 and the reflection plane 630 and to further reduce the total size of the antenna structure 600. As to the antenna theory, the function of the outer ring portion 631 of the reflection plane 630 of FIG. 6 is substantially equivalent to the function of the closed-loop conductor 120 of FIG. 1. Accordingly, the embodiments of FIG. 6 and FIG. 1 can achieve similar levels of performance.

In addition to the above designs, the antenna structure of the invention may further comprise other dipole antenna elements and closed loop slots with different shapes. Please refer to the following embodiments.

Figure 8:
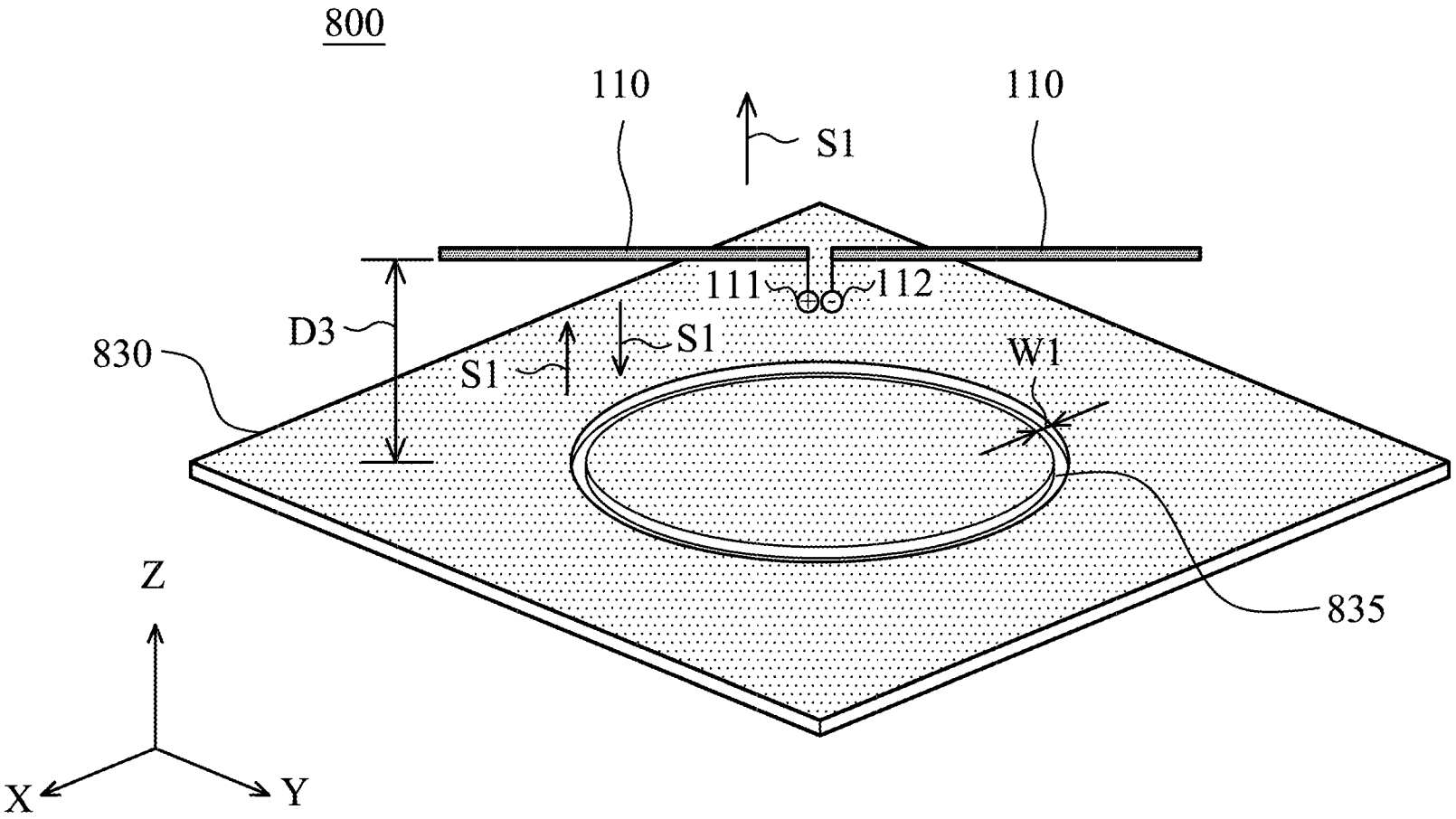
FIG. 8 is a diagram for illustrating an antenna structure according to an embodiment of the invention.

FIG. 8 is a diagram for illustrating an antenna structure 800 according to an embodiment of the invention. FIG. 8 is similar to FIG. 6. In the embodiment of FIG. 8, a closed loop slot 835 of a reflection plane 830 of the antenna structure 800 substantially has a circular shape. The first dipole antenna element 110 has a vertical projection (i.e., the normal vector of the projection plane is parallel to the Z-axis) on the reflection plane 830, and the vertical projection is substantially aligned with a diameter of the circular shape (e.g., the length of the vertical projection is greater than the length of the diameter). Other features of the antenna structure 800 of FIG. 8 are similar to those of the antenna structure 600 of FIG. 6. Accordingly, the two embodiments can achieve similar levels of performance.

Figure 9:
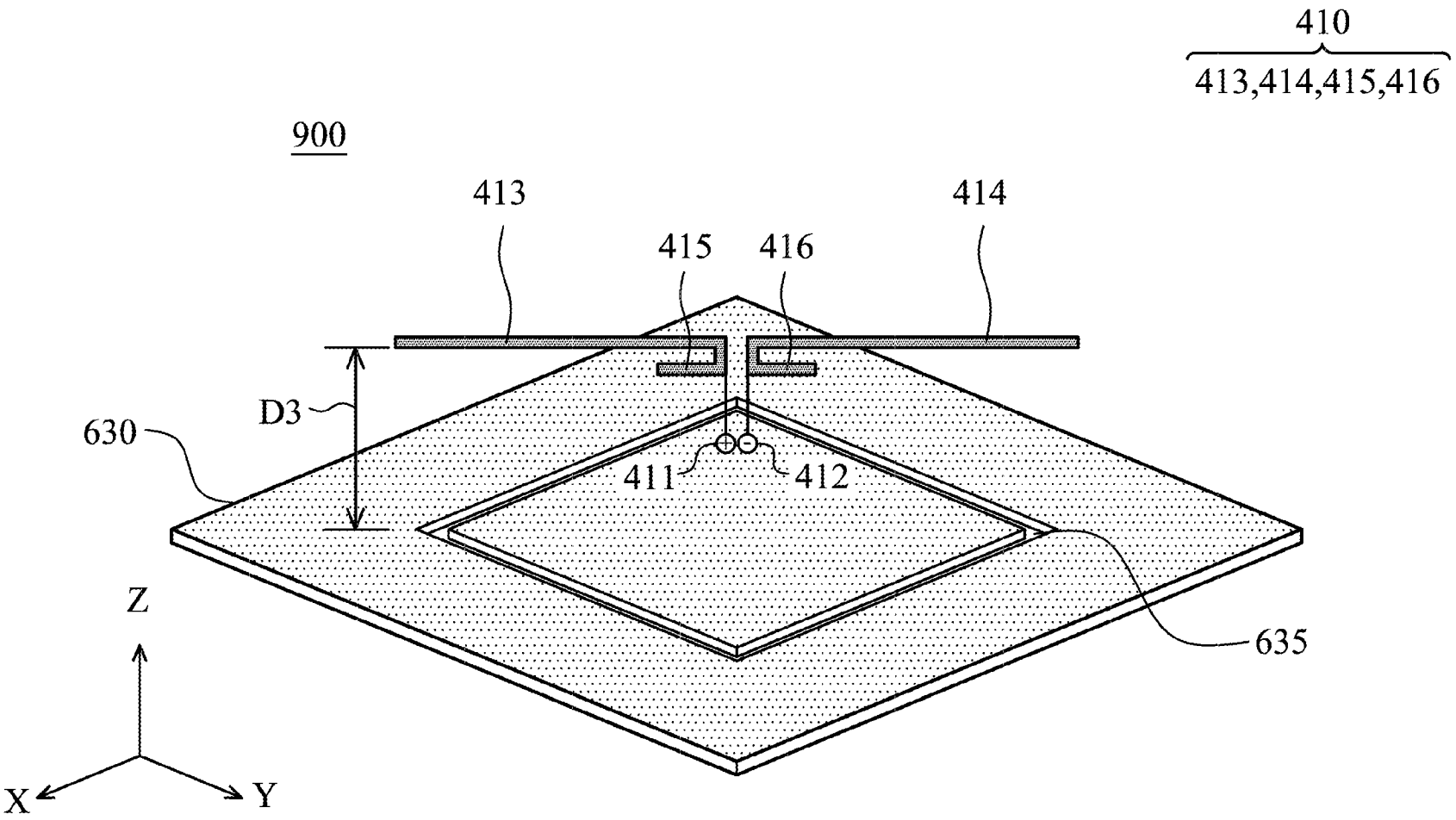
FIG. 9 is a diagram for illustrating an antenna structure according to an embodiment of the invention.

FIG. 9 is a diagram for illustrating an antenna structure 900 according to an embodiment of the invention. FIG. 9 is similar to FIG. 6. In the embodiment of FIG. 9, a first dipole antenna element 410 of the antenna structure 900 comprises at least four radiation branches 413, 414, 415, and 416 to cover dual bands. The detailed structure of the first dipole antenna element 410 may be described in the embodiment of FIG. 4. Other features of the antenna structure 900 of FIG. 9 are similar to those of the antenna structure 600 of FIG. 6. Accordingly, the two embodiments can achieve similar levels of performance.

Figure 10:
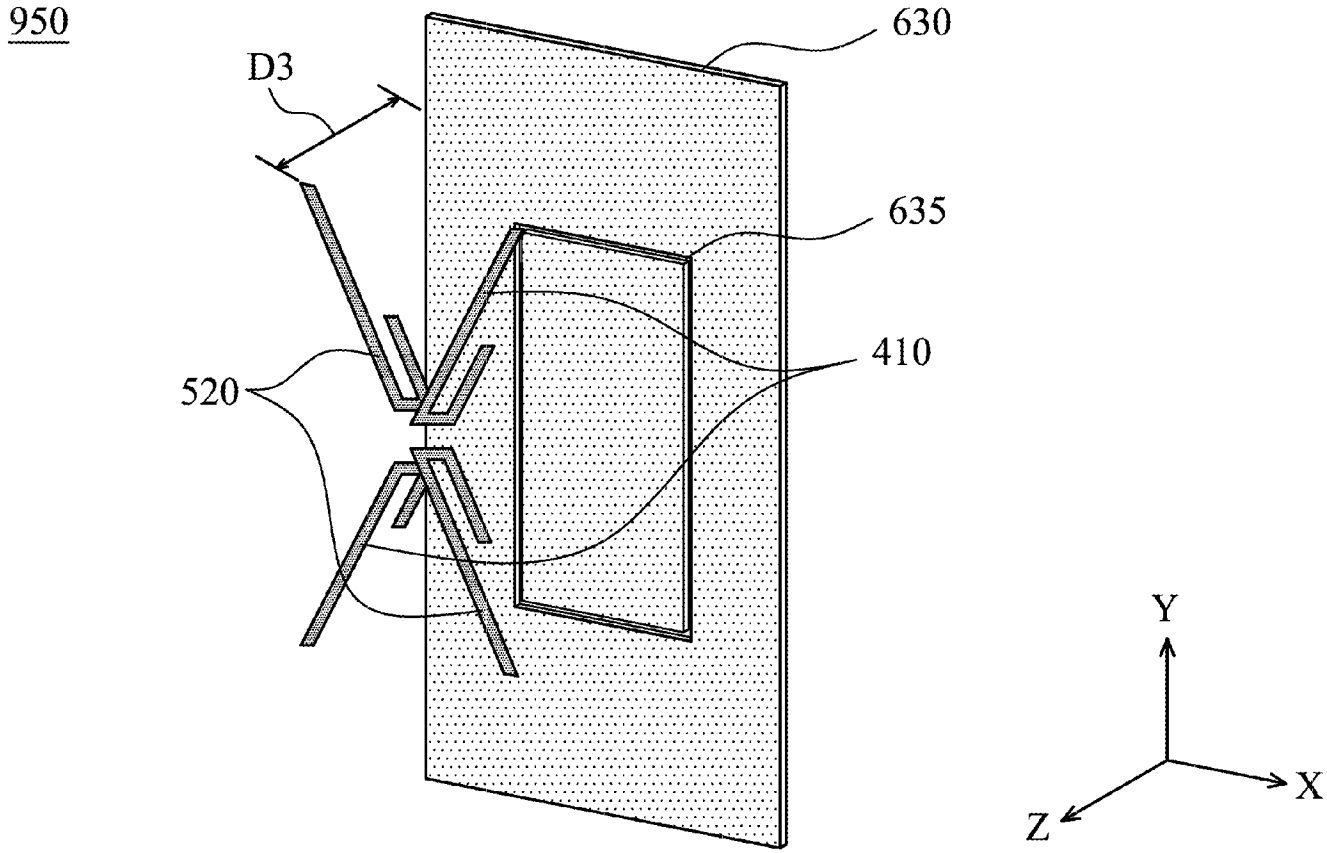
FIG. 10 is a diagram for illustrating an antenna structure according to an embodiment of the invention.

FIG. 10 is a diagram for illustrating an antenna structure 950 according to an embodiment of the invention. FIG. 10 is similar to FIG. 6. In the embodiment of FIG. 10, the antenna structure 950 further comprises a second dipole antenna element 520. The second dipole antenna element 520 is identical to the first dipole antenna element 410, and the difference between them is that the second dipole antenna element 520 is further rotated by 90 degrees. The detailed structures of the first dipole antenna element 410 and the second dipole antenna element 520 may be described in the embodiments of FIG. 1, FIG. 4, and FIG. 5. The second dipole antenna element 520 is disposed substantially perpendicular to the first dipole antenna element 410, and transmits a second electromagnetic signal S2. The reflection plane 630 is further configured to reflect the second electromagnetic signal S2 from the second dipole antenna element 520. The mutual coupling effect between the outer ring portion 631 of the reflection plane 630 and the second dipole antenna element 520 effectively causes the distance D3 between the second dipole antenna element 520 and the reflection plane 630 to be shorter. Since the second dipole antenna element 520 and the first dipole antenna element 410 are substantially orthogonal to each other, the antenna structure 950 can have dual linear polarizations to receive or transmit electromagnetic signals in different directions. Other features of the antenna structure 950 of FIG. 10 are similar to those of the antenna structure 600 of FIG. 6. Accordingly, the two embodiments can achieve similar levels of performance.

Note that the aforementioned element sizes, element parameters, and element shapes are not limitations of the invention. An antenna engineer can adjust these settings according to different requirements. In addition, the antenna structure of the invention is not limited to the configurations of FIGS. 1-10. The invention may merely include any one or more features of any one or more embodiments of FIGS. 1-10. In other words, not all of the features shown in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first dipole antenna element, transmitting a first electromagnetic signal;

a closed-loop conductor, disposed adjacent to the first dipole antenna element; and a reflection plane, reflecting the first electromagnetic signal from the first dipole antenna element to enhance the total gain of the antenna structure;

wherein the first dipole antenna element is substantially between the closed-loop conductor and the reflection plane, or the closed-loop conductor is substantially between the first dipole antenna element and the reflection plane;

wherein the distance between the first dipole antenna element and the reflection plane is substantially equal to 0.125 wavelength of the central operation frequency of the first dipole antenna element.

2. The antenna structure as claimed in claim 1, wherein a mutual coupling effect between the closed-loop conductor and the first dipole antenna element causes the distance between the first dipole antenna element and the reflection plane to be shorter.

3. The antenna structure as claimed in claim 1, wherein the distance between the first dipole antenna element and the closed-loop conductor is substantially from 1 mm to 2 mm.

4. The antenna structure as claimed in claim 1, wherein the length of the closed-loop conductor is substantially from 1.1 to 1.7 wavelength of the central operation frequency of the first dipole antenna element.

5. The antenna structure as claimed in claim 1, wherein the closed-loop conductor substantially has a square shape, the first dipole antenna element has a vertical projection on the closed-loop conductor, and the vertical projection is substantially aligned with a diagonal of the square shape.

6. The antenna structure as claimed in claim 1, wherein the closed-loop conductor substantially has a circular shape, the first dipole antenna element has a vertical projection on the closed-loop conductor, and the vertical projection is substantially aligned with a diameter of the circular shape.

7. The antenna structure as claimed in claim 1, wherein the first dipole antenna element comprises at least four radiation branches to cover dual bands.

8. The antenna structure as claimed in claim 1, further comprising:

a second dipole antenna element, disposed substantially perpendicular to the first dipole antenna element, and transmitting a second electromagnetic signal, wherein the closed-loop conductor is adjacent to the second dipole antenna element, the reflection plane reflects the second electromagnetic signal from the second dipole antenna element, and the antenna structure has dual linear polarizations.

9. The antenna structure as claimed in claim 8, wherein the second dipole antenna element comprises at least four radiation branches to cover dual bands.

10. An antenna structure, comprising:

a first dipole antenna element, transmitting a first electromagnetic signal; and a reflection plane, having a closed loop slot, wherein the reflection plane reflects the first electromagnetic signal from the first dipole antenna element to enhance the total gain of the antenna structure.

11. The antenna structure as claimed in claim 10, wherein the reflection plane comprises an outer ring portion disposed outside the closed loop slot, and a mutual coupling effect between the outer ring portion and the first dipole antenna element causes the distance between the first dipole antenna element and the reflection plane to be shorter.

12. The antenna structure as claimed in claim 11, wherein the distance between the first dipole antenna element and the reflection plane is substantially equal to 0.125 wavelength of the central operation frequency of the first dipole antenna element.

13. The antenna structure as claimed in claim 10, wherein the length of the closed loop slot is substantially from 0.8 to 1.2 wavelength of the central operation frequency of the first dipole antenna element.

14. The antenna structure as claimed in claim 10, wherein the closed loop slot substantially has a square shape, the first dipole antenna element has a vertical projection on the reflection plane, and the vertical projection is substantially aligned with a diagonal of the square shape.

15. The antenna structure as claimed in claim 10, wherein the closed loop slot substantially has a circular shape, the first dipole antenna element has a vertical projection on the reflection plane, and the vertical projection is substantially aligned with a diameter of the circular shape.

16. The antenna structure as claimed in claim 10, wherein the first dipole antenna element comprises at least four radiation branches to cover dual bands.

17. The antenna structure as claimed in claim 10, further comprising:

a second dipole antenna element, disposed substantially perpendicular to the first dipole antenna element, and transmitting a second electromagnetic signal, wherein the reflection plane reflects the second electromagnetic signal from the second dipole antenna element, and the antenna structure has dual linear polarizations.

18. The antenna structure as claimed in claim 17, wherein the second dipole antenna element comprises at least four radiation branches to cover dual bands.

* * * * *